US005512716A

United States Patent [19]

Buchien

[11] Patent Number: 5,512,716

[45] Date of Patent: Apr. 30, 1996

[54] SWITCHING PAD OR PLATE

[75] Inventor: Fritz D. Buchien, Schelklingen, Germany

[73] Assignee: Mayser GmbH & Co., Ulm, Germany

[21] Appl. No.: 284,421

[22] PCT Filed: Nov. 26, 1993

[86] PCT No.: PCT/EP93/03329

§ 371 Date: Aug. 2, 1994

§ 102(e) Date: Aug. 2, 1994

[87] PCT Pub. No.: WO94/12996

PCT Pub. Date: Jun. 9, 1994

[30] Foreign Application Priority Data

Dec. 3, 1992 [DE] Germany ..... 42 40 622.6

[51] Int. Cl.[6] ..... H01H 3/14

[52] U.S. Cl. ..... 200/86 R; 200/85 R

[58] Field of Search ..... 200/5 A, 85 R, 200/85 A, 86 R, 86 A, 512, 61.57

[56] References Cited

U.S. PATENT DOCUMENTS

| | | | |
|---|---|---|---|
| 1,891,751 | 12/1932 | Coyne | 200/86 R |
| 2,945,099 | 7/1960 | Mayhew | 200/61.57 |
| 3,553,404 | 1/1971 | Koenig | 200/85 R |
| 3,654,407 | 4/1972 | Kepner et al. | 200/86 R |
| 4,519,474 | 5/1985 | Iseli et al. | 200/512 X |
| 4,987,277 | 1/1991 | Duhon | 200/86 R |

FOREIGN PATENT DOCUMENTS

| | | | |
|---|---|---|---|
| 00440285A2 | 8/1991 | European Pat. Off. | H01H 3/14 |
| 3821305C2 | 2/1990 | Germany | F16P 3/12 |
| 1394064 | 5/1975 | United Kingdom | H01H 1/26 |

OTHER PUBLICATIONS

Abstract, Switching Pad or Plate, WO94/12996, Jun. 9, 1994.

*Primary Examiner*—J. R. Scott

*Attorney, Agent, or Firm*—Evenson, McKeown, Edwards & Lenahan

[57] ABSTRACT

A switching pad or plate having electroinsulating flat bodies arranged essentially in parallel to one another, to which at least one current-conducting contact path is assigned which has disconnecting switches disposed in series and are actuated by pressure on one of the flat bodies. Contact pins are assigned to the disconnecting switches which contact pins subjected to spring force, rest against the contact path by a contact head. The contact pins are firmly connected at the end facing away from the contact head with one of the flat bodies and each contact pin is movably held in a guide which is formed by an insulating flat body.

7 Claims, 3 Drawing Sheets

SWITCHING PAD OR PLATE

BACKGROUND AND SUMMARY OF THE INVENTION

The invention relates to a switching pad or plate having electroinsulating flat bodies arranged essentially in parallel to one another, to which at least one current-conducting contact path is assigned which has disconnecting switches disposed in series which are actuated by pressure on one of the flat bodies, with contact pins being assigned to the disconnecting switches and, subjected to spring force, resting against the contact path.

Switching pads are known, for example, from German Patent Document DE 38 21 305 A1 in which two switching strips are installed in a switching pad made of a rubber-elastic material, each switching strip comprising a plurality of contact plates which adjoin one another by their end edges and are held together by expander cords which extend through them. A contact path extends in these contact plates, and the arrangement is such that each of the contact plates has contact points at its ends which are connected with the contact points of the adjacent plate-shaped element. When the switching pad is touched and when, as a result, the plate-shaped elements are moved apart, the contact points are disconnected so that the electric circuit is interrupted.

As a rule, switching pads of this type cannot also be constructed to be sufficiently sensitive for causing a switching operation when pressures are low.

A switching pad of the type is known from British Patent Document GB 1 394 064 in which leaf springs are provided either on one side or one both sides of an insulating base plate. The leaf springs from the current-conducting contact path. At certain points, the leaf springs are provided with bores through. Contact pins made of steel reach through the bores via a wide head which is in each case pressed from the outside against the leaf springs which in turn, are pressed against the head as a result of their intrinsic elasticity. When pressure is exercised on the leaf springs, the head of the contact pin is therefore released so that the current path is interrupted. This applies to the embodiment shown in the above-mentioned British Patent Document GB 1 394 064 having a contact pin which is fixedly arranged on the base plate. This also applied to a variant which is also shown in which the contact pin, by means of two contact heads each provided on its end, is held between two leaf springs arranged on both sides of the base plate. In constructions of this type, the triggering of a switching operation may be endangered if the pressure on the device is carried out directly in the area of the switching head of a contact pin. This is because, even when leaf springs are actuated, the contact pin may still rest there with a certain area of its circumference against the bore in the leaf springs. A secure switching operation is therefore possible only when corresponding monitoring devices are used for monitoring the current flow. A sensitive operation is not possible using constructions of this type.

It is therefore an object of the invention to develop a switching pad or plate of the initially mentioned type in such a manner that, a sensitive operation is possible and that also, the whole area of the switching pad or plate can be divided into small areas. Touching of these areas results in an interruption of the contact.

These and other objects are achieved by the present invention which provides a switching pad comprising electroinsulating flat bodies arranged substantially in parallel to one another, at least one current-conducting contact path assigned to the flat bodies, the current-conducting path having disconnecting switches disposed in series and which are actuated by pressure on one of the flat bodies. Contact pins are assigned to the disconnecting switches and each has a contact head and an end facing away from the contact head, the contact pins biased by a spring force to rest by the contact heads against the contact path. The contact pins are firmly connected by the end facing away from the contact head with one of the flat bodies. At least one of the flat bodies forms an insulating guide in which the contact pins are movably held.

With the present invention the whole area of the switching pad or plate can be provided with contact elements whose spacing is determined only by the size of the contact heads and the insulating distance required between adjacently extending branches of the contact path. This invention therefore permits a very fine subdivision of the switching pad or plate area with contact elements. Because of the small size of the contact elements and the direct connection of the switching pins with one of the flat bodies, the invention also permits a sensitive operation.

In certain embodiments of the invention, characteristics are provided which permit a compact and flat construction.

According to certain embodiments of the invention, two switching circuits are formed which act independently of one another. A switching pad or plate which is constructed in this manner has two redundant security systems and can therefore be used particularly where increased demands are made on security. In this case, the invention may expediently be implemented such that the contact path assigned to one of the plates or pads and the contact heads interacting with it extend at a distance from the contact path assigned to the other plate or pad. In this case, the contact path of one of the plates or pads expediently extends in each case in the center between the parallel branches of the meandering contact path of the other plate or pad.

In certain embodiments of the invention, sensors are assigned to the indentations which, when the switching pin is actuated, are actuated by the contact head interrupting the contact path. The reason is that this makes it possible to determine in each case at which point the interruption of the contact path has taken place. This is an important advantage, for example, for security devices by means of which it is also to be determined where an operator is situated.

Other objects, advantages and novel features of the present invention will become apparent from the following detailed description of the invention when considered in conjunction with the accompanying drawings.

BRIEF DESCRIPTION OF THE DRAWINGS

FIG. 1 is a top view of a first embodiment of a switching plate which has two plates, disposed on one another, and a guide plate arranged in-between.

DETAILED DESCRIPTION OF THE DRAWINGS

Figure 1:
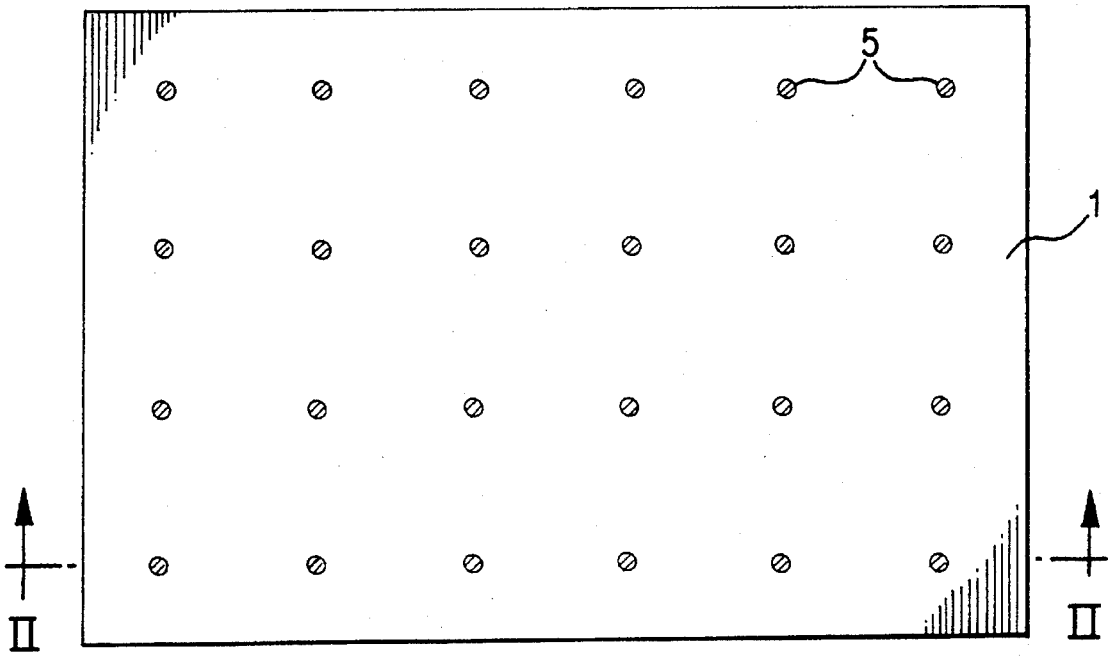
Figure 2:
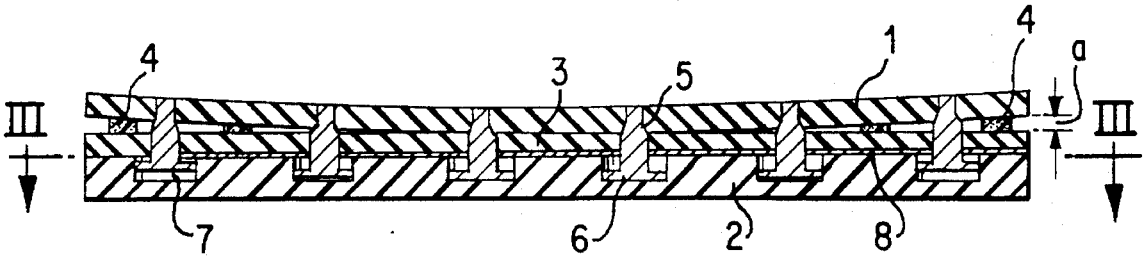
FIG. 2 is a sectional view according to Line II—II of FIG. 1.
Figure 3:
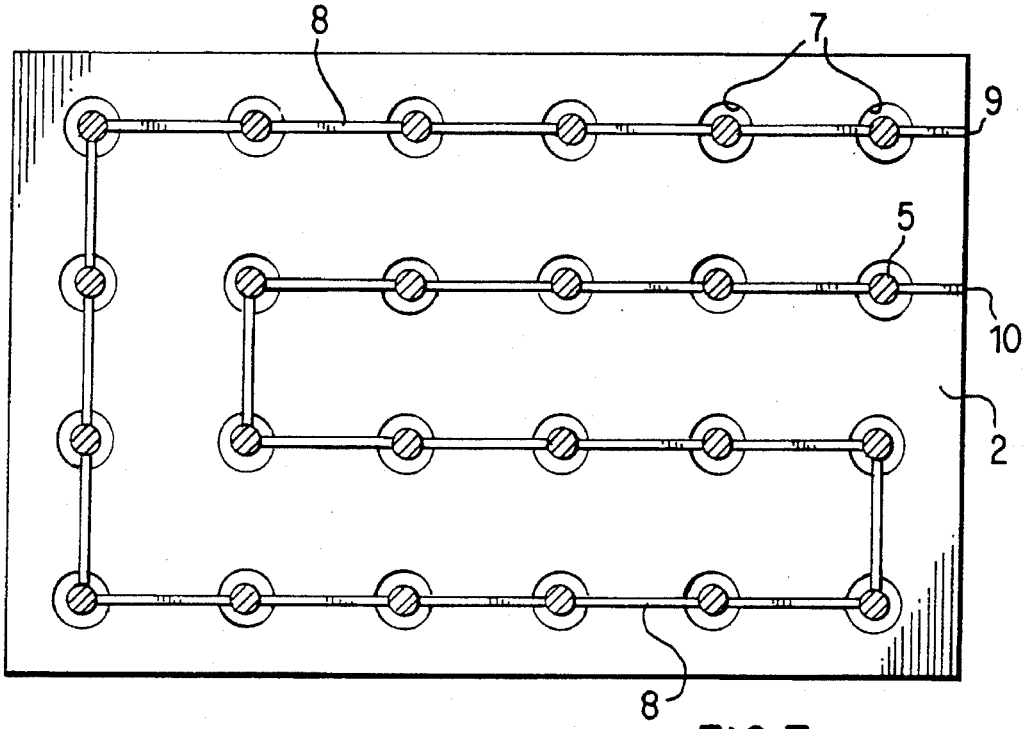
FIG. 3 is a sectional view of the switching plate of FIG. 1 and 2 along Line III—III in FIG. 2.

FIGS. 1 to 3 are schematic representations of a switching plate which two flat bodies in the form of plates 1 and 2 which are arranged essentially in parallel with one another. The top plate 1 of the two plates has a certain elasticity and, with respect to the bottom plate 2 and a guide plate 3 arranged in-between, is elastically disposed as a result of the fact that foam strips 4, which may also be part of a foam mat provided with punched-out areas, provide a certain narrow distance (a) between the top plate 1 and the guide plate 3 when the top plate 1 is not touched and is inoperative. In the position illustrated in FIG. 2, a certain force is exercised on the center of the plate 1. It is therefore slightly bent in the center.

The plates 1, 2 and 3 are made of an insulating material. The ends of contact pins 5 are firmly connected with the top plate 1. In the illustrated embodiment, the contact pins 5 are sized so as to change from their fastening end which in each case is fitted in the plate 1, to a portion having larger diameter which, in turn, is guided in the guide plate 3 in a longitudinally displaceable manner. On their end faces away from the fastening end, the contact pins 5 have a disk-shaped contact head 6. Like contact pins 5, the contact head 6 is made of an electrically conductive material. It is provided in certain embodiments to produce the contact pins 5 formed from a non-conductive material, and place contact heads 6 on them which are made of a conductive material. However, the one-piece manufacturing of the contact pins 5 from an electrically conductive material, such as aluminum, is simpler.

As illustrated in FIGS. 2 and 3, the contact heads are each received in circular indentations 7 adapted to the dimensions of the contact heads 6. The indentations 7 are provided in the lowest plate 2 and have a depth which, in each case, corresponds to the maximal switching path of the contact pins 5. This maximal switching path is provided by the distance (a) which exists in the inoperative position between the top plate 1 and the guide plate 3.

As illustrated in FIGS. 1 and 3, the contact pins 5 and the indentations 7 are each arranged in parallel rows and at the same distance from one another. This is done so that the contact pins 5 are distributed in the manner of a grid on the entire surface of the top plate 1 used for actuating.

A contact path 8 extends between the guide plate 3 and the bottom plate 2. The contact path 8 is designed in such a manner that, in each case, it intersects the axes of the contact pins 5, and therefore also crosses the area of the contact heads 6. The contact path 8 meanders through the areas of the contact heads 6 and has connection points 9 and 10 at which a current supply can be applied laterally to the switching plate.

As illustrated in FIGS. 3 and 2, the contact path 8, which may, for example, be firmly connected with the guide plate 3, extends laterally into the area of the indentations 7 so that it reaches under the contact heads 6. When the top plate 1 is not actuated, all switching pins 5 with their contact heads 6 are therefore disposed in series. The switching circuit connected to points 9 and 10 is closed.

When now, as indicated in FIG. 2, the top plate 1 is bent by the force acting upon it, at least one switching head 6 is pressed so far into its indentation 7 that the contact path 8 is interrupted or opened at the point where the path normally connect with the contact head 6. Thus, also the switching circuit is interrupted.

The representation of FIG. 2 is Selected such that not only one of the switching heads 6 interrupts the contact path by the bending of the plate 1, but several switching heads are shown interrupting the contact path 8. However, the development may easily also be implemented such that, in the case of a larger dimension of the plate 1 and of a local deformation, possibly only one switching head is pressed into its indentation 7. However, this would nonetheless also lead to an interruption of the switching circuit. Each of the switching pins 5 represents a disconnecting switch. The actuating of the disconnecting switch results in the interruption of the switching circuit which can be used for the monitoring.

Figure 4:
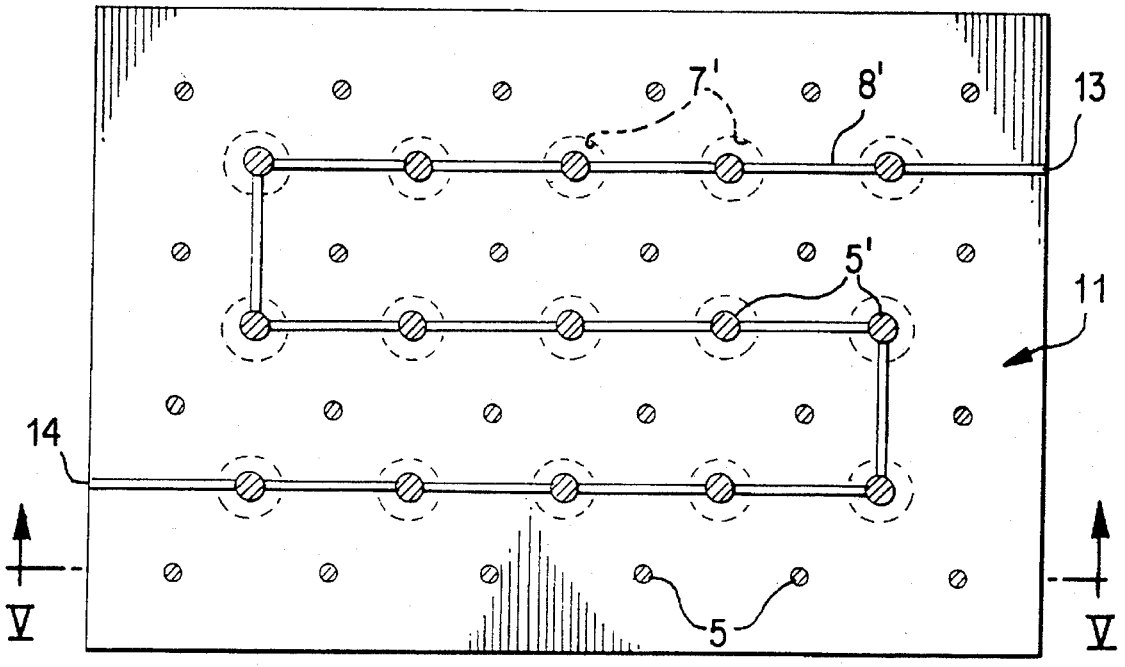
FIG. 4 is a sectional view of another embodiment of a switching plate with two switching plates placed against one another and each connected with switching pins according to the invention along Line IV–IV in FIG. 5.
Figure 5:
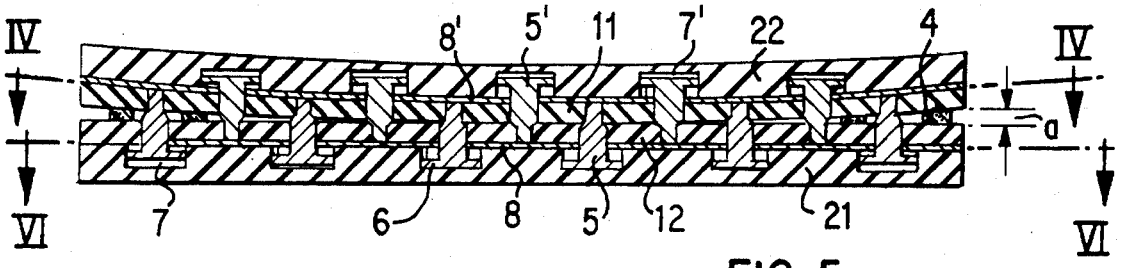
FIG. 5 is a sectional view of the switching plate of FIG. 4 along Line V—V.
Figure 6:
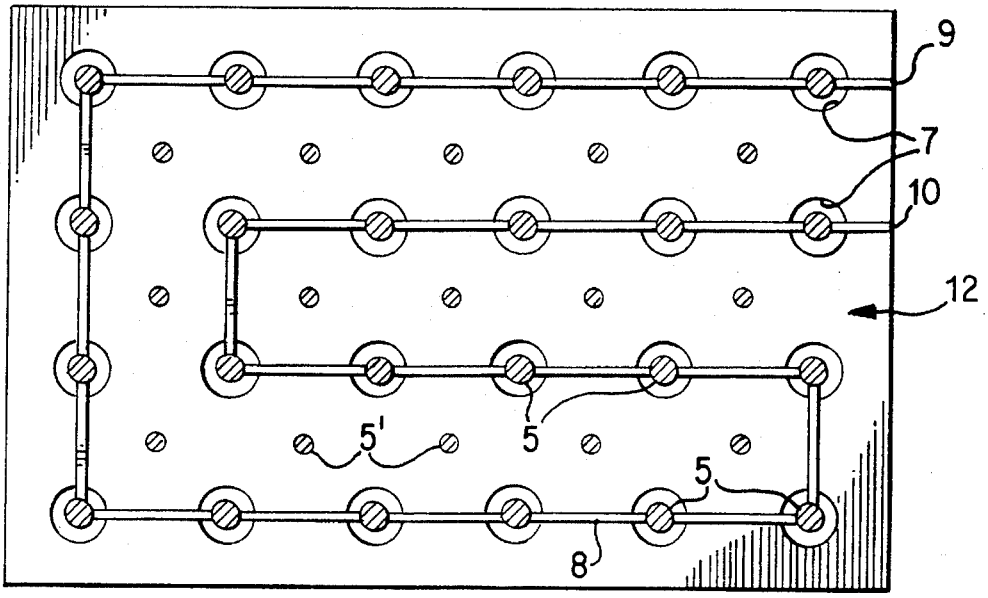
FIG. 6 is a sectional view of the switching plate of FIGS. 4 and 5 along Line VI—VI in FIG. 5.

FIGS. 4 to 6 show a modification of the switching plate of FIGS. 1 to 3 in that here only two plates 11 and 12, each being fixed with the ends of the switching pins 5 and 5' and being rotated with respect to one another by 180°, are placed on one another by the interposing of the foam strips 4 in such a manner that the switching space (a) is formed between them. In this case, the bottom plate 21 with its indentations 7 is assigned to plate 11 and its switching pins 5. The top cover plate 22 with the indentations 7' is assigned to the bottom plate 12 and its switching pins 5'. In this embodiment, which therefore corresponds approximately to the double construction of the switching plate of FIGS. 1 to 3, a plates 11 and 12 each take over the function of a guide plate for the switching pins 5 and 5'. Plate 12 is therefore used as the guide plate for the switching pins 5 which are firmly connected with plate 11, and inversely, plate 11 is used as the guide plate for the switching pins 5' that are firmly connected with plate 12. As illustrated in FIG. 5, when a force is exercised on the top cover plate 22 and when plate 11 is therefore deformed, the switching pins 5 of this plate 11 are pressed into the indentations 7 of the bottom cover plate 21. At the same time, the switching pins 5' of the bottom plate 12 are also pressed into the indentations 7' of the top cover plate 22. Since, in each case, on the side of plate 12 facing plate 21, contact path 8, and on the side of plate 11 facing plate 22, contact path 8' extend in an identical manner, as explained above with respect to FIGS. 2 and 3, in the case of the embodiment of the switching plate of FIGS. 4 to 6, the switching circuit applied to the connection points 9 and 10 as well as the switching circuit which is applied to points 13 and 14 of the top plate 11 are interrupted. Therefore, the embodiment of FIGS. 4 to 6, in a simple manner, provides the possibility of a switching plate equipped with two redundant security circuits.

Figure 7:
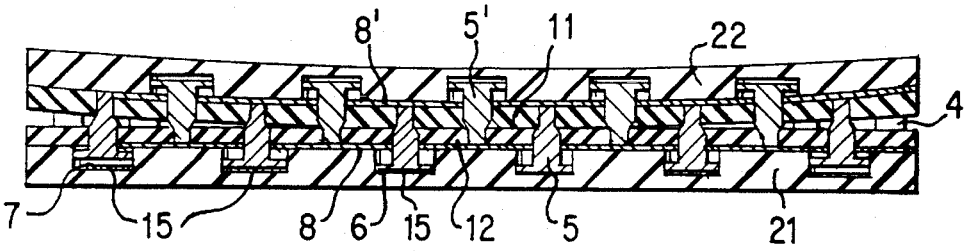
FIG. 7 is a sectional representation of a switching plate similar to FIG. 5, but with additionally arranged sensors.

FIG. 7 illustrates an embodiment by which using simple devices, the position of the disconnecting switches can also be indicated. The disconnected switches are formed by the contact pins 5 and each cause the interruption of the switching circuit. For this purpose, sensors 15 are in each case mounted on the base of the indentations 7 of the cover plate 21. When the switching head of the switching pin 5 pressed downward by the switching path is pressed into the assigned indentation 7, the sensors permit the emitting of a signal by which the point of the respective triggered disconnecting switch can be located. The sensors 15 are constructed, for example, as piezoelectric elements and are connected with an indicator panel via contact paths which are not shown in detail. This type of an embodiment also makes it possible to indicate, for example, the position of an operator relative to a robot monitored by the switching plate of the invention in order to, for example, switch off in time moving operations of the robot when the operator comes too close to the danger zone.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A switching pad comprising:

electroinsulating flat bodies arranged substantially in parallel to one another;

at least one current-conducting contact path arranged between said flat bodies;

a plurality of switches coupled in series and spaced apart along said current-conducting path and being actuated to interrupt said current conducting path;

wherein said switches are formed by contact pins, each of said contact pins having a contact head and an end facing away from the contact head; and a spring providing a spring force to bias said contact pins such that their contact heads electrically contact the contact path to form a closed current-conducting path, wherein the contact pins are firmly connected by the end facing away from the contact head with one of the flat bodies, and wherein at least one of said flat bodies forms an insulating guide in which the contact pins are movably held;

whereby pressure on one of said flat bodies actuates at least one of said switches by countering said spring force to open the electrical contact between the contact head of the contact pin and the contact path.

2. A switching pad according to claim 1, wherein the guide has a side which faces away from a first one of the flat bodies, said first flat body being connected with the contact pins, a second one of said flat bodies, which is not connected with the contact pins, being provided on said side of the guide and having indentations for movement of the contact pins, the guide being positioned between the first and second flat bodies, the contact path meandering over the surface of the second flat body between the second flat body and the guide and crossing an area of the contact heads.

3. A switching pad according to claim 1, wherein first and second insulating guides for the contact pins are respectively formed by first and second ones of said flat bodies, each of the first and second flat bodies being respectively firmly connected with a subset of said contact pins and guiding another subset of said contact pins, wherein third and fourth ones of the flat bodies cover the first and second flat bodies, the third and fourth flat bodies having indentations on sides facing away from the first and second flat bodies firmly connected with the contact pins for movement of the contact heads, a first of said at least one contact path having a meandering pattern over the surface of the first flat body between the first flat body and the third flat body and crossing an area of the contact head is of the subset of said contact pins so as to form a first switching circuit, and a second contact path having a meandering pattern over the surface of the second flat body between the second flat body and the fourth flat body and crossing an area of the contact heads of the other subset of said coating pins so as to form a second switching circuit, and wherein said first and second switching circuits are electrically independent of one another.

4. A switching pad according to claim 3, further comprising sensors arranged in the indentations, said sensors being actuated by the contact head which interrupts the contact path when a contact pin is actuated.

5. A switching pad according to claim 3, wherein the first contact path over the first flat body and the contact heads interacting with the first contact path extends at a distance from the second contact path over the second flat body.

6. A switching pad according to claim 5, wherein one of said first and second contact paths extends in a center between parallel branches of the other of said first and second contact paths.

7. A switching pad according to claim 2, further comprising sensors arranged in the indentations, said sensors being actuated by the contact head which interrupts the contact path when a contact pin is actuated.

* * * * *